United States Patent [19]

Rule et al.

[11] Patent Number: 5,028,504

[45] Date of Patent: Jul. 2, 1991

[54] INFRARED-SENSITIVE PHOTOCONDUCTOR ELEMENTS INCORPORATING A CYANINE DYE AND A PERYLENE PIGMENT

[75] Inventors: Norman G. Rule, Rochester; William J. Staudenmayer, Pittsford, both of N.Y.

[73] Assignee: Eastman Kodak Company, Rochester, N.Y.

[21] Appl. No.: 417,113

[22] Filed: Oct. 4, 1989

[51] Int. Cl.[5] ..... G03G 5/14

[52] U.S. Cl. ..... 430/58; 430/59

[58] Field of Search ..... 430/58, 59

[56] References Cited

U.S. PATENT DOCUMENTS 4,334,000 6/1982 Chang et al. ..... 430/59

FOREIGN PATENT DOCUMENTS 54-104835 6/1978 Japan .
60-260052 12/1985 Japan .
61-292158 12/1986 Japan .

*Primary Examiner*—David Welsh
*Attorney, Agent, or Firm*—Dressler, Goldsmith, Shore, Sutker & Milnamow, Ltd.

[57] ABSTRACT

A reusable photoconductor element is provided which has sensitivity in the near infrared spectral region. The element employs successively applied layers of perylene dicarboximide pigment and cyanine dye.

6 Claims, 3 Drawing Sheets

INFRARED-SENSITIVE PHOTOCONDUCTOR ELEMENTS INCORPORATING A CYANINE DYE AND A PERYLENE PIGMENT

FIELD OF THE INVENTION

This invention is in the field of photoconductor elements that have sensitivity in the near infrared region.

BACKGROUND OF THE INVENTION

Various organic pigments have been utilized as charge generation layers in reusable photoconductor elements, and these elements have exhibited good sensitivity and stability to ambient conditions. However, these elements tend to suffer from the disadvantage that they lack sensitivity in the near infrared region and also perform poorly in high-speed applications, such as LED/laser exposure sources used in electronic printers.

Cyanine dyes are known to display sensitivity in the near-infrared region. Various efforts have been made to improve the spectral sensitivity of such dyes in the near infrared region. For example, photoconductive compositions of mixtures of cyanine dyes and perylene pigments appear to be taught by the following patent publications: Jap. 61292158-A, Jap. 60260052-A, and Jap. 54104835.

SUMMARY OF THE INVENTION

This invention provides a reusable, multilayered photoconductor element having sensitivity in the near-infrared spectral region which employs as a charge generation layer a perylene dicarboximide pigment layer that is overcoated with a cyanine dye.

The photoconductor element comprises successive adhering layers of:

(a) a support layer;
(b) an electrically conductive layer;
(c) a barrier layer;
(d) a charge generation layer comprising at least one photosensitive perylene dicarboximide pigment that is overcoated with at least one photosensitive cyanine dye; and
(f) a charge transport layer.

Presently preferred perylene dicarboximide pigments are characterized by the formula: wherein:

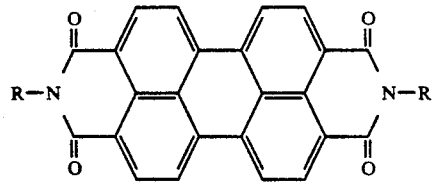

(1)

wherein:

R is an arylalkylene group.

As used herein, the term "arylalkylene" includes straight or branched chain alkylene linking groups containing less than 7 carbon atoms that are attached to an aryl group. The term "aryl" as used herein means mono or poly cyclic hydrocarbon fused or nonfused aromatic ring systems which can contain one or more hetero atoms such as N, 0 or S in the ring system. An aryl group can be substituted by one through four lower alkyl or alkoxy groups. Preferred aryl groups are phenyl groups. A presently preferred arylalkylene group is phenyl(lower)alkylene.

Representative perylene pigments are disclosed in U.S. Pat. Nos. 3,871,882; 3,904,407; 4,156,757; 4,419,427; 4,429,029; 4,514,482; 4,517,270; 4,578,334; and 4,719,163.

Presently preferred cyanine dyes are characterized by the generic formula:

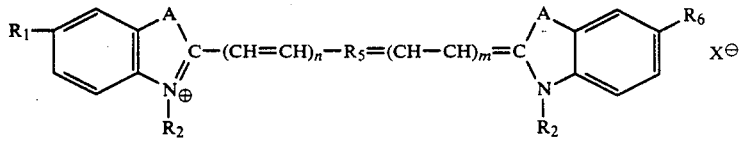

(2)

wherein:

A is C $R_3R_4$ or S;

$R_1$ and $R_6$ are independently selected from hydrogen, nitro and $-SO_2CH_3$;

$R_2$, $R_3$ and $R_4$ are alkyl;

$R_5$ is

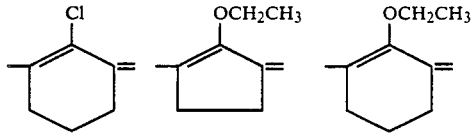

n is an integer of 1 through 3;

m is an integer of 1 through 3; and

X is an anion.

The term "anion" as used herein designates a negatively charged ion which satisfies a net positive charge inherently associated with the chromophore-group-containing organic structure of formula (2) compounds. A preferred anion in formula (2) compounds is $PF_6$. $R_3$ and $R_4$ are preferably methyl, $R_2$ is preferably methyl or $-C_{18}H_{37}$ and n and m are preferably 1.

In the second charge generation layer, such cyanine dye can be dispersed in a polymeric binder.

In the photoconductor elements of this invention, the perylene pigment acts as a sensitizer for the cyanine dye. The photoconductor elements display greater sensitivity in the near infrared region than either the perylene pigment or the cyanine dye used alone in a charge generation layer. Indeed, the perylene pigment appears to exhibit little or no measurable photoresponse in the near infrared region.

Other and further aims, features, advantages, and the like will be apparent to those skilled in the art when taken with the accompanying drawings and appended claims.

DETAILED DESCRIPTION

Figure 3:
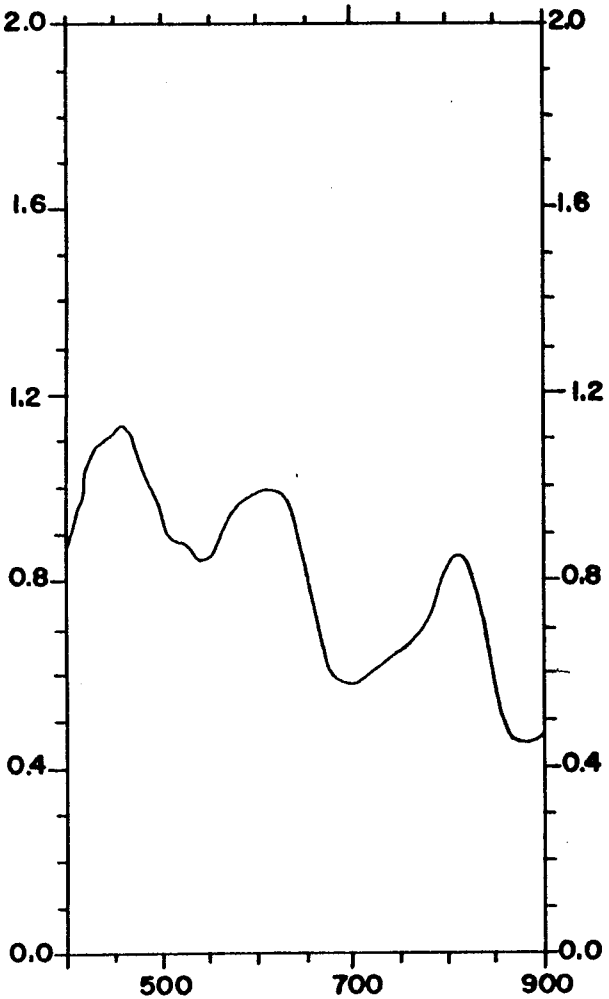
FIG. 3 is a plot showing the spectral absorption characteristics of the photoconductor element of Example 1 wherein the abscissa shows wavelength in nanometers (nm) and the ordinate shows intensity in absorbance.

For purposes of the present invention, the term "pigment" as used herein means a finely divided (usually less than about 1 micron in average diameter), substantially completely insoluble (in both water and organic solvents), white, black, or colored particulate material that imparts color to another substance or to a mixture of substances.

Similarly, for purposes of the present invention, the term "dye" as used herein means a natural or synthetic colorant which is soluble in organic solvents, and sometimes in aqueous media, and which can be used in solution to stain materials. A dye characteristically consists of at least one chromophore group and at least one salt-forming group. The chromophore group(s) are responsible for the color of a dye.

The term "cyanine dye" as used herein denotes a dye containing two heterocyclic groups (usually quinoline nuclei) connected by a chain of conjugated double bonds containing an odd number of carbon atoms. The term is inclusive of, for example, so called simple cyanines; isocyanines; merocyanines, including cyanine dyes which contain an amidic chromophore system; cryptocyanines; carbocyanines; polycarbocyanines, such as dicarbocyanine, tricarbocyanines, and the like; symmetrical as well as unsymmetrical cyanine dyes; chain-methine substituted cyanine dyes; cyanine blue; and dyes which contain the amidinium moiety, as described in the Mees and James book "The Theory of the Photographic Process", published by McMillan Co. (1966) pp. 201-202.

The perylene dicarboximide pigments of formula (1) above are generally vaporized and deposited on a substrate under conventional conditions. Characteristically, after being vaporized and deposited on a surface under such conditions, a perylene dicarboximide pigment is in an amorphous solid state and displays photosensitivity in the range of about 400 to about 700 nm.

For purposes of this invention, the term "near infrared region" as used herein means spectral wave lengths in the range of about 700 to about 900 nm.

Cyanine dyes selected for use in this invention, including the preferred compounds of formula (2), are photosensitive in the near infrared region.

For purposes of the present invention a term such as "photo response" or "photosensitivity" means the capacity of a dye, or a pigment, to be stimulated by light.

The photoconductor elements of this invention can employ conventional substrates, films or sheet materials, as the support layer. The support layer is relatively thermally stable, electrically insulative, and has dielectric strength. Examples of polymers used in films include cellulose acetate, polystyrene, polycarbonates, polyesters, such as polyethylene terephthalate, and the like. Presently preferred substrates are polyethylene terephthalate and polycarbonates.

The photoconductor elements of this invention can employ various electrically conductive layers. For example, the conductive layer can be a metal foil which is conventionally laminated to the support layer. Suitable metal foils include those comprised of aluminum, zinc, copper, and the like. The support layer and the conductive layer can be formulated as a consolidated layer which can be a metal plate, for example, including plates formed of metals such as aluminum, copper, zinc, brass and galvanized steel plates. Alternatively, vacuum deposited metal layers upon a substrate are suitable and are presently preferred, such as deposited silver, nickel, gold, aluminum, chromium, and metal alloys. The thickness of a vapor deposited metal layer can be in the range of about 50 to 1000 Angstroms. Conductive layers can also comprise a particulate or dissolved organic or inorganic conductor or semi-conductor distributed in a binder resin. For example, a conductive layer can comprise compositions of protective inorganic oxide and about 30 to about 70 weight percent of conductive metal particles, such as a vapor deposited conductive cermet layer as described in U.S. Pat. No. 3,880,657. Also see in this connection the teachings of U.S. Pat. No. 3,245,833 relating to conductive layers employed with barrier layers. Organic conductive layers can be employed, such as those comprised of a sodium salt of a carboxyester lactone of maleic anhydride in a vinyl acetate polymer, as taught, for example in U.S. Pat. Nos. 3,007,901 and 3,262,807.

In the photoconductor elements of the invention, the conductive layer is overcoated by a barrier layer. The barrier or subbing layer typically has a dry thickness in the range of about 0.01 to about 5 microns. Typical subbing layers are solvent soluble film-forming polymers, such as, for example, cellulose nitrate, polyesters, copolymers of poly(vinyl pyrrolidone) and vinylacetate, and various vinylidene chloride-containing polymers including 2, 3 and 4 component polymers prepared from a polymerizable blend of monomers or prepolymers containing at least 60% by weight of vinylidene chloride. Representative vinylidene chloride-containing polymers include vinylidene chloride-methyl methacrylate-itaconic acid terpolymers as disclosed in U.S. Pat. No. 3,143,421. Various vinylidene chloride-containing hydrogel tetrapolymers which may be used include tetrapolymers of vinylidene chloride, methyl acrylate, acrylonitrile and acrylic acid such as disclosed in U.S. Pat. No. 3,640,780. Other useful vinylidene chloride-containing copolymers include poly(vinylidene chloride-methyl acrylate), poly(vinylidene chloride-methacrylonitrile), poly(vinylidene chloride-acrylonitrile), and poly(vinylidene chloride-acrylonitrile-methyl acrylate). Other subbing materials include the so called tergels described in U.S. Pat. No. 3,501,301 and the vinylidene chloride terpolymers described in U.S. Pat. No. 3,228,770. One useful class of subbing layers is comprised of a hydrophobic film-forming polymer or copolymer that is free from any acid-containing group, such as a carboxyl group, that is prepared from a blend of monomers or prepolymers, each of said monomers or prepolymers containing one or more polymerizable ethylenically unsaturated groups. Examples of such a polymer include many of the aforenamed copolymers, and, in addition, copolymers of polyvinylpyrrolidone and vinyl acetate, poly(vinylidene chloride-methyl methacrylate), and the like.

While any convenient method of application of a subbing layer can be used, it is presently preferred to dissolve the polymer (such as above characterized) in a solvent and then to coat the solution over the conductive layer.

The barrier layer coating composition can also contain minor amounts of various optional additives, such as surfactants, levelers, plasticizers, and the like.

A barrier layer coating composition is comprised of polymer and less than about 1 weight percent of total additive(s). In a barrier layer coating composition, the total solids content can range from about 8 to about 15 weight percent with the balance up to 100 weight percent thereof being solvent or carrier liquid.

Mixtures of different solvents or liquids can be employed. Preferably, the solvents are volatile, that is, evaporable, at temperatures below about 50° C. Examples of suitable solvents include aromatic hydrocarbons, such as benzene, toluene, xylene, mesitylene, etc.; ketones, such as acetone, 2-butanone, etc.; ethers, such as cyclic ethers, like tetrahydrofuran, ethyl ether, etc.; petroleum ether; alkanols, such as isopropyl alcohol, etc.; halogenated aliphatic hydrocarbons, such as methylene dichloride, chloroform, and ethylene chloride, etc.; and the like. Presently preferred coating solvents are dichloromethane and trichloroethylene.

The barrier layer coating composition is applied by using a technique such as knife coating (preferred), spray coating, swirl coating, extrusion hopper coating, or the like. After application, the coating composition is conveniently air dried.

The charge generation layer is applied over the barrier layer by exposing the barrier layer to a perylene dicarboximide pigment of formula (1) above using the vacuum and elevated temperature conditions above indicated. Alternatively, a dispersion of the pigment in a carrier liquid can be applied to the barrier layer, followed by drying. Conveniently, a coating weight of from about 0.05 to about 0.20 grams per square foot ($g/ft^2$) of pigment is applied to the barrier layer which corresponds to a dry coating thickness in the range of about 0.5 to about 2.0 microns. The perylene dicarboximide pigment is in an amorphous form. Typically, in this form, the layer has an orange color.

At least one cyanine dye is then applied to the perylene dicarboximide pigment layer by solvent coating or other conventional techniques.

It is presently preferred to incorporate a binder polymer into the cyanine dye coating composition. As the binder polymer, any of the solvent soluble, film forming, preferably hydrophobic, organic polymers previously known to the photoconductor element art as binder polymers can be used. These polymers, when in solid form, preferably display dielectric strength and electric insulation properties. Suitable polymers include, for example, vinyltoluene-styrene copolymers, styrene-butadiene copolymers; silicone resins; styrenealkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinylacetals), such as poly(vinyl butyral); polyacrylic and methacrylic esters, such as poly(methyl methacrylate), a poly(-n-butyl methacrylate), poly(isobutyl methacrylate), etc.; polystyrene; nitrated polystyrene; polymethylstyrene; isobutylene polymers; polyesters, such as poly[ethylene-co-alkylene -bis(alkylene-oxyaryl))-phenylenedicarboxylate]; phenolformaldehyde resins; ketone resins; polyamides; polycarbonates; polythiocarbonates; poly[ethylene-co -isopropylidene-2,2-bis(ethyleneoxyphenylene)terephthalate]; copolymers of vinyl haloarylates and vinyl acetate, such as poly-(vinyl-m-bromobenzoate -co-vinyl acetate); and the like. Preferred polymers are polycarbonates and polyesters.

The cyanine dye coating composition can contain minor amounts of various additives, such as surfactants, levelers, plasticizers, sensitizers, and the like.

On a total solids basis, the cyanine dye coating composition comprises about 0.05 to about 5.0 weight percent of cyanine dye, about 20.0 to about 80.0 weight percent of binder polymer (as above identified), and about 5.0 to about 50.0 weight percent of total additives. The components are preferably dissolved in a solvent liquid. The total solids content of the composition is conveniently in the range of about 1.0 to about 20.0 weight percent with the balance up to 100 weight percent thereof being solvent. Mixtures of different solvents can be employed.

Conveniently, the cyanine dye coating composition is applied by coating over the perylene pigment layer using a technique such as knife coating (preferred), spray coating, swirl coating, extrusion hopper coating, or the like. Preferably, the amount of cyanine dye applied is in the range of about 0.0005 to about 0.05 $g/ft^2$, and more preferably is in the range of from about 0.001 to about 0.02 $g/ft^2$. After application, the coating is conveniently air dried.

The actual thickness of the cyanine layer upon the perylene layer is difficult to state because the deposited cyanine dye appears to be at least partially absorbed by the perylene pigment layer. The cyanine dye and the perylene dicarboximide pigment appear to merge with probably most of the dye being absorbed by the pigment. The resulting composition is not a physical mixture of dye and pigment.

A charge transport layer is applied over the charge generation layer. Typically, the charge transport layer has a thickness in the range of about 5 to about 25 microns and can contain any organic or inorganic charge transport agent. Most charge transport agents preferentially accept and transport either positive charges (holes) or negative charges (electrons), although materials are known which will transport both positive and negative charges. Those exhibiting a preference for conduction of positive charge carriers are called p-type transport materials, and those exhibiting a preference for the conduction for negative charges are called n-type transport agents. Various p-type organic compounds can be used in the charge-transport layer such as:

1. Carbazoles including carbazole, N-ethyl carbazole, N-isopropyl carbazole, N-phenyl carbazole, halogenated carbazoles, various polymeric carbazole materials such as poly(vinyl carbazole), halogenated poly(vinyl carbazole), and the like.

2. Arylamines including monoarylamines, diarylamines, triarylamines and polymeric arylamines. Specific arylamine organic photoconductors include the nonpolymeric triphenylamines illustrated in U.S. Pat.

No. 3,180,730; the polymeric triarylamines described in U.S. Pat. No. 3,240,597; the triarylamines having at least one aryl radical substituted by either a vinyl radical or a vinylene radical having at least one active hydrogen-containing group, as described in U.S. Pat. No. 3,567,450; the triarylamines in which at least one aryl radical is substituted by an active hydrogen-containing group, as described by U.S. Pat. No. 3,658,520; and tritolylamine.

3. Polyarylalkanes of the type described in U.S. Pat. Nos. 3,274,000; 3,542,547; and 3,615,402. Preferred polyarylalkane photoconductors are of the formula:

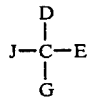

wherein:

D and G, which may be the same or different, each represent an aryl group and J and E, which may be the same or different, each represent a hydrogen atom, an alkyl group, or an aryl group, and at least one of D, E and G contain an amino substituent. An especially useful charge-transport material is a polyarylalkane wherein J and E represent hydrogen, aryl or alkyl, and D and G represent a substituted aryl group having as a substituent thereof a group of the formula:

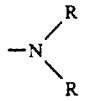

wherein:

R is an unsubstituted aryl group such as phenyl or an alkyl-substituted aryl group such as a tolyl group. Examples of such polyarylalkanes may be found in U.S. Pat. No. 4,127,412.

4. Strong Lewis bases such as aromatic compounds, including aromatically unsaturated heterocyclic compounds free from strong electron-withdrawing groups. Examples include tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1,4-bromopyrene, polyvinyltetracene, polyvinyl perylene and polyvinyl tetraphene.

5. Hydrazones including the dialkyl-substituted aminobenzaldehyde(diphenylhydrazones) of U.S. Pat. No. 4,150,987; alkylhydrazones and arylhydrazones as described in U.S. Pat. Nos. 4,554,231; 4,487,824; 4,481,271; 4,456,671; 4,446,217; and 4,423,129, which are illustrative of the p-type hydrazones.

Other useful p-type charge transport agents are the p-type photoconductors described in Research Disclosure, Vol. 109, May, 1973, pages 61–67, paragraph IV(A) (2) through (13).

Representative of n-type charge transports are strong Lewis acids, such as organic, including metalloorganic, compounds containing one or more aromatic, including aromatically unsaturated heterocyclic, groups bearing an electron-withdrawing substituent. These are useful because of their electron-accepting capability. Typical electron withdrawing substituents include cyano; nitro; sulfonate; halogens such as chlorine, bromine and iodine; ketone groups; ester groups; acid anhydride groups; and other acid groups such as carboxyl and quinone groups. Representative n-type aromatic Lewis acids having electron-withdrawing substituents include phthalic anhydride, tetrachlorophthalic anhydride, benzil, mellitic anhydride, S-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, 4,6-dichloro-1,3-dinitrobenzene, 4,6-dibromo-1,3-dinitrobenzene, p-dinitrobenzene, chloranil, bromanil, 2,4,7-trinitro-9-fluorenone, 2,4,5,7-tetranitrofluorenone, trinitroanthracene, dinitroacridine, tetracyanopyrene, dinitroanthraquinone, and mixtures thereof.

Other useful n-type charge transports are conventional n-type organic photoconductors, for example, complexes of 2,4,6-trinitro-9-fluorenone and poly(vinyl carbazole). Still others are the n-type photoconductors described in Research Disclosure, Vol. 109, May, 1973, pages 61–67, paragraph IV(a) (2) through (13).

A single charge-transport layer or more than one can be employed. Where a single charge-transport layer is employed, it can be either a p-type or an n-type substance.

Preferably, p-type charge transport agents are employed in charge transport layers of this invention.

The charge transport agent(s) is/are compounded with a polymeric binder. Preferably both the charge transport agent and the polymeric binder are dissolved in a carrier liquid. Presently preferred polymeric binders for use in a charge transport layer of the present invention are polycarbonates and polyesters.

A charge transport layer coating composition can contain additives, such as a surfactant, a leveler, a plasticizer, or the like.

A charge transport layer coating composition on a 100 weight percent total solids basis can comprise about 5.0 to about 50.0 weight percent of charge transport agent(s), about 20.0 to about 80.0 weight percent of binder polymer, and less than about 1.0 weight percent of total additives. A charge transport layer coating composition contains about 1.0 to about 20.0 weight percent total solids with the balance up to 100 weight percent thereof being solvent.

A charge transport layer coating composition is conveniently applied by a technique such as knife coating (preferred), spray coating, swirl coating, extrusion hopper coating, or the like. After application such coating is conveniently air dried.

If desired, each of the coating compositions hereinabove described, after application and drying, can be subjected to a curing step. Convenient curing temperatures range from about 50° to about 110° C. applied for times of about 1 to about 20 minutes.

Figure 1:
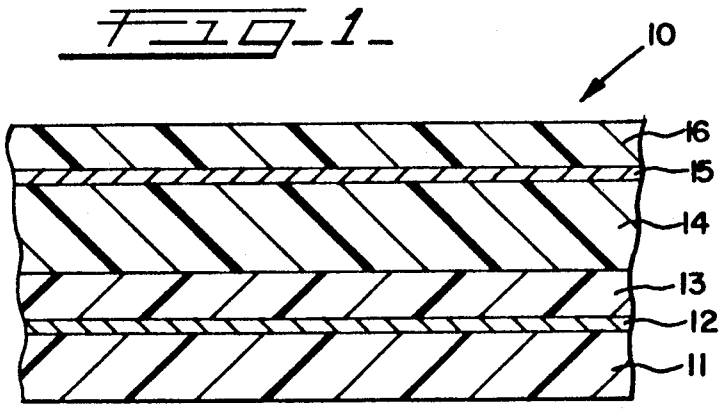
FIG. 1 is a fragmentary enlarged vertical sectional view through one embodiment of a photoconductor element of the present invention.
Figure 2:
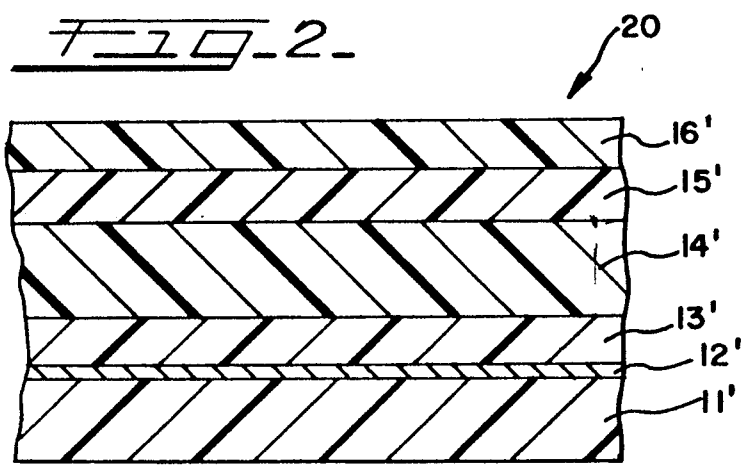
FIG. 2 is a view similar to FIG. 1 but showing another embodiment of a photoconductor element of the present invention.

Illustrative structures of photoconductor elements of the present invention are exemplified in FIGS. 1 and 2. Referring to FIG. 1 there is a seen one embodiment of a photoconductor film element of this invention which is designated in its entirety by the numeral 10.

Element 10 incorporates a substrate 11 comprised of a polymeric film as above described. Substrate 11 can have a thickness which varies widely but typically is in the range from about 100 to about 200 microns.

Substrate 11 is coated on one surface with an electrically conductive layer 12, as above described, which, in the embodiment shown, is comprised of a vapor deposited layer of metal. A preferred such metal is nickel.

Layer 12 is overcoated with a charge barrier or subbing layer 13, such as hereinabove described. In turn, layer 13 is overcoated with a layer of perylene dicarboximide pigment of formula (1). Over layer 14, a cyanine layer 15 is coated, as above described.

Layer 15 is believed to exist initially after being coated. Since the layer 15 tends to be absorbed by the layer 14, the layer 15 can be regarded as having a transitory existence after the layers 14 and 15 have in effect merged together through absorption of the dye layer 15 into the layer 14.

The element 10 is overcoated with a charge transport layer 16, as above described.

Referring to FIG. 2 there is seen another embodiment of a photoconductor element of the present invention which embodiment is designated in its entirety by the numeral 20 for convenience. Embodiment 20 is similar to embodiment 10 and incorporates similar component layers which are similarly numbered but which have prime marks added thereto for identification purposes. In the embodiment 20, layer 15' comprises a combination of at least one photosensitive cyanine dye, (preferably a dye of formula (2)), dispersed in a binder polymer. Optional additives may be present as hereinabove explained. In the embodiment 20, some of the cyanine dye in the layer 15' may migrate into the layer 14, but, because of the presence of the polymeric binder, some of the cyanine dye is believed to remain permanently distributed in the layer 15'.

In the case of both embodiments 10 and 20, when the respective charge transport layer 16 or 16' is applied to the element structure, the pigment comprising the respective first charge generation layers 14 and 14' is observed to undergo a conversion from the initial amorphous condition to a crystalline condition. Concurrently, a color change from the initial amorphous orange color to a crystalline green color is observed. The cyanine dye is theorized to be absorbed into the crystalline structure of the perylene dicarboximide pigment. However, there is no intent to be bound by theory herein.

Photoconductor elements of the present invention display a sensitivity to radiation in the near infrared region which is substantially greater than the corresponding sensitivity displayed by either the pigment or the dye utilized separately in similar element. Indeed, the pigment appears to be relatively insensitive and even entirely non-responsive to radiation in the near infrared region.

Photoconductor film elements of this invention are generally reusable, and display great sensitivity in the near infrared spectral region (about 700 to 900 nm) along with high image resolution characteristics. Also, these elements require reduced amounts of energy for discharge compared with the same elements wherein either cyanine dye or the perylene pigment is used separately.

The invention is illustrated by the following examples:

EXAMPLE 1 PREPARATION OF PHOTOCONDUCTOR ELEMENT OF THE INVENTION

A polyethylene terephthalate film about 175 microns thick (obtained commercially from Eastman Kodak under the trademark "ESTAR") is subjected to vacuum vapor deposition of nickel to produce a nickel coating on one face thereof which is approximately 800 Angstroms thick and electrically conductive to 102 ohms/cm$^2$. The nickel conductive layer is overcoated by a conventional solvent coating method with a barrier layer coating composition comprised of 0.5% solids in methyl ethyl ketone to produce a vinylidene chloride copolymer barrier layer about 0.05 microns thick.

The resulting layered film structure is then subjected to vacuum vapor deposition under conditions as described in U.S. Pat. No. 4,578,334 of a perylene dicarboximide pigment characterized by the structure:

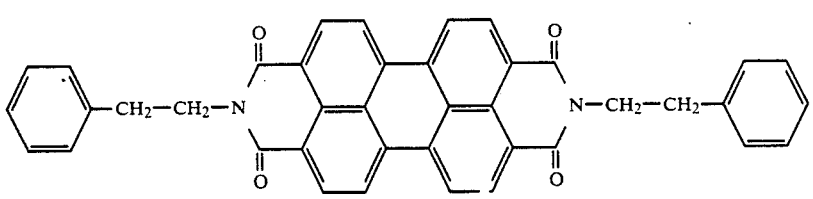

(3)

The deposition rate was 380 mg/m$^2$ which corresponds to a coating thickness of about 0.2 microns.

This perylene dicarboximide pigment layer constituted a first layer which was overcoated with a coating composition containing cyanine dye as shown in Table I:

TABLE I

| Composition | |
|---|---|
| Component | Wt. in Grams |
| Polycarbonate[1] | 0.0325 |
| 1,1-bis(4-di-p tolylaminophenyl) cyclohexane | 0.0175 |
| Sensitizer[2] | 0.005 |
| Dichloromethane | 5.0 |

Table I footnotes:
[1]The polycarbonate was purchased commercially from the General Electric Company under the Trademark "Lexan 145".
[2]The spectral sensitizer was a cyanine dye characterized by the formula

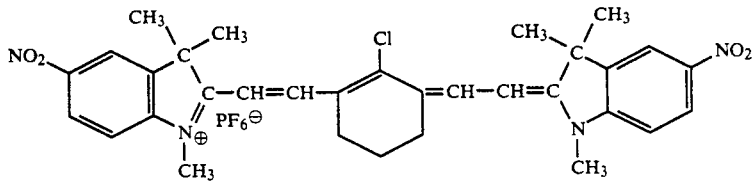

(4)

The composition of Table I was coated over the first layer with a 0.001 inch coating blade. The coated layer was dried and then cured for one hour at 60° C. The coating weight of the cyanine dye was about 0.01 g/ft$^2$.

A charge transport layer was then applied. The charge transport layer coating composition was as shown in Table II:

TABLE II

| Charge Transport Layer Coating Composition | |
|---|---|
| Component | Wt. in Grams |
| Polycarbonate[1] | 0.78 |
| 1,1-bis(4-di-p-tolylamino-phenyl)cyclo hexane | 0.42 |
| Dichloromethane | 10.0 |

Table II Footnote:
[1]The polycarbonate was obtained commercially from the General Electric Company under the trademark "Lexan 145".

The charge transport layer composition was coated with a 0.007 inch coating blade over the dry second charge generation layer composition and then air dried and cured for one hour at 60° C.

The spectral absorption characteristics of this resulting film element were measured by a conventional spectrophotometer and found to be as shown in FIG. 3.

EXAMPLE 2 (CONTROL)

The procedure of Example 1 was repeated except that the perylene dicarboximide pigment layer was omitted from the multi-layer element structure.

Figure 4:
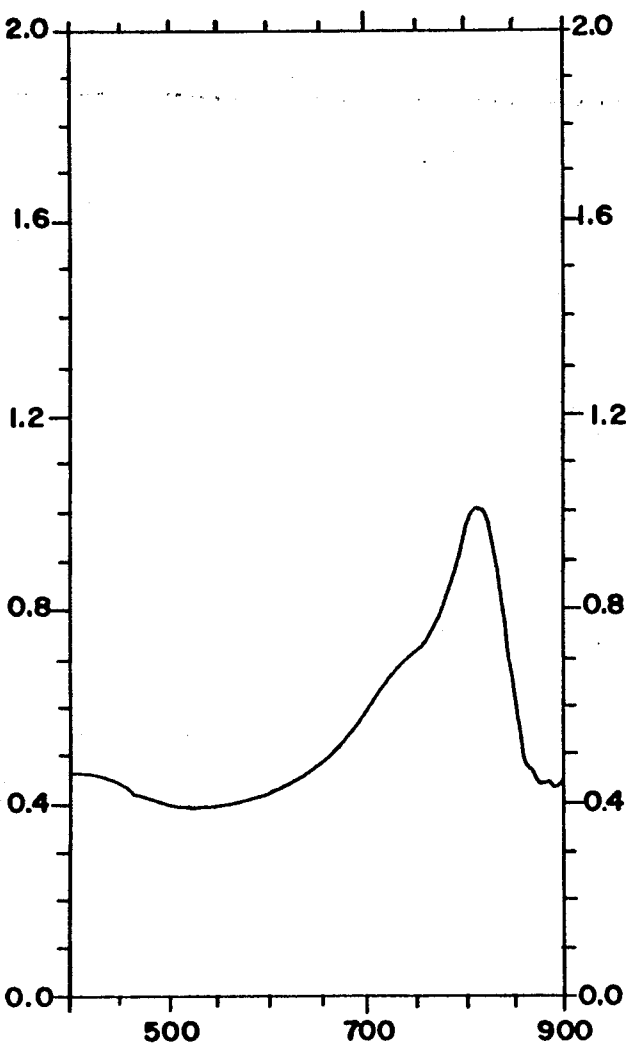
FIG. 4 is a plot similar to the plot of FIG. 3 showing the spectral absorption characteristics of the photoconductor element of Example 2.

The spectral absorption characteristics of this film were found to be as shown in FIG. 4.

EXAMPLE 3 (CONTROL)

The procedure of Example 1 was repeated except that the second charge generation layer containing the cyanine dye was omitted from the multi-layer element structure.

Figure 5:
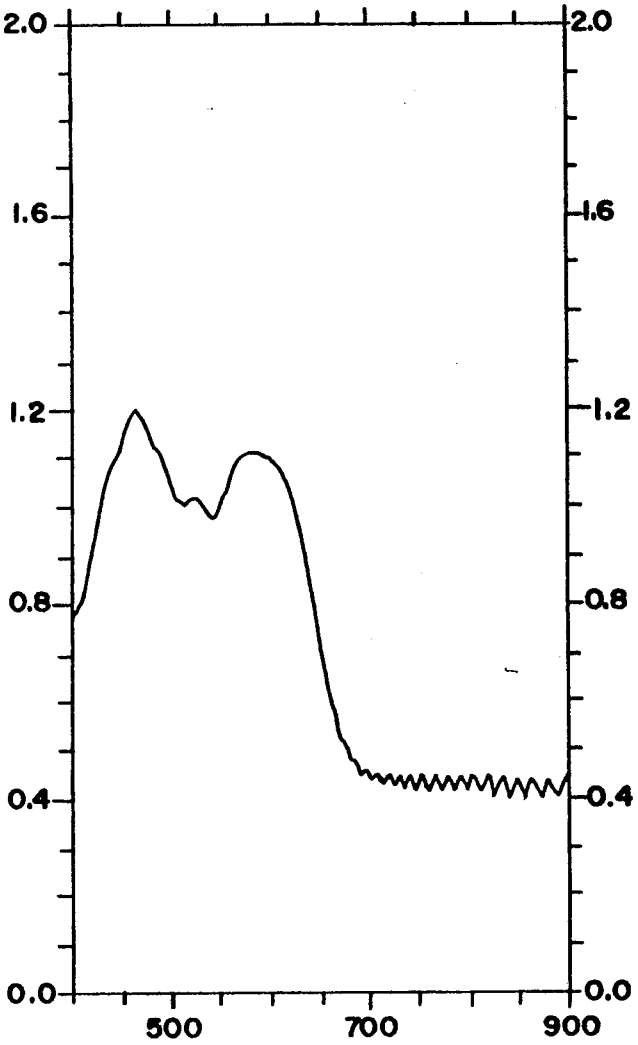
FIG. 5 is a plot similar to the plot of FIG. 3 showing the spectral absorption characteristics of the photoconductive film element of Example 3.

The spectral absorpotion characteristics of this film were similarly found to be as shown in FIG. 5.

EXAMPLE 4 (CONTROL)

The procedure of Example 1 was repeated except that the cyanine dye was omitted from the second charge generation layer.

Figure 6:
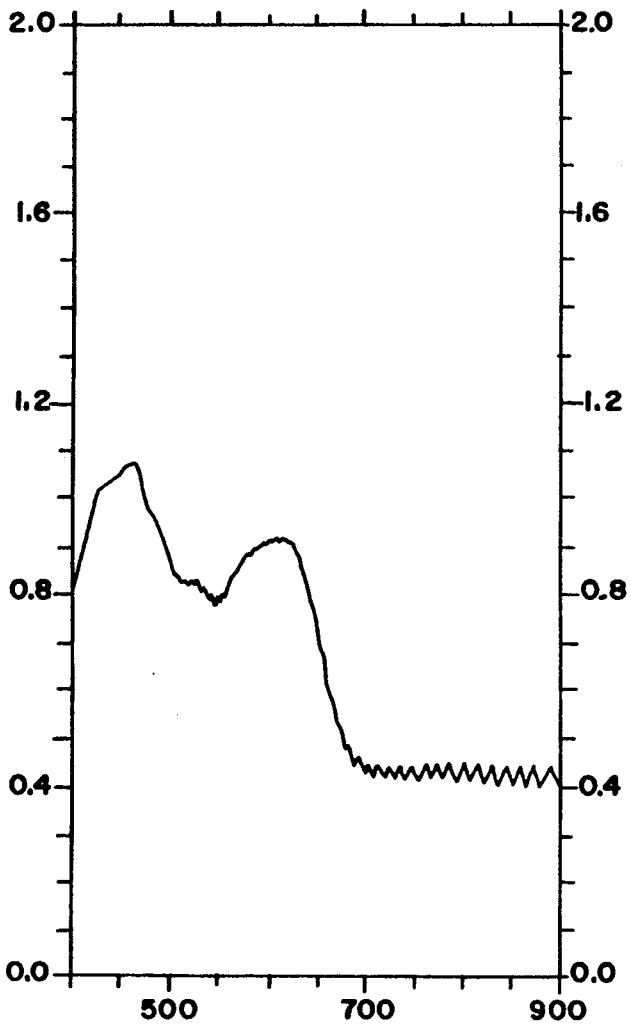
FIG. 6 is a plot similar to the plot of FIG. 3 showing the spectral absorption characteristics of the photoconductor element of Example 4.

Spectral absorption of the product film element were found to be as shown in FIG. 6.

EXAMPLE 5 PREPARATION OF A PHOTOCONDUCTOR ELEMENT OF THE INVENTION

Figure 7:
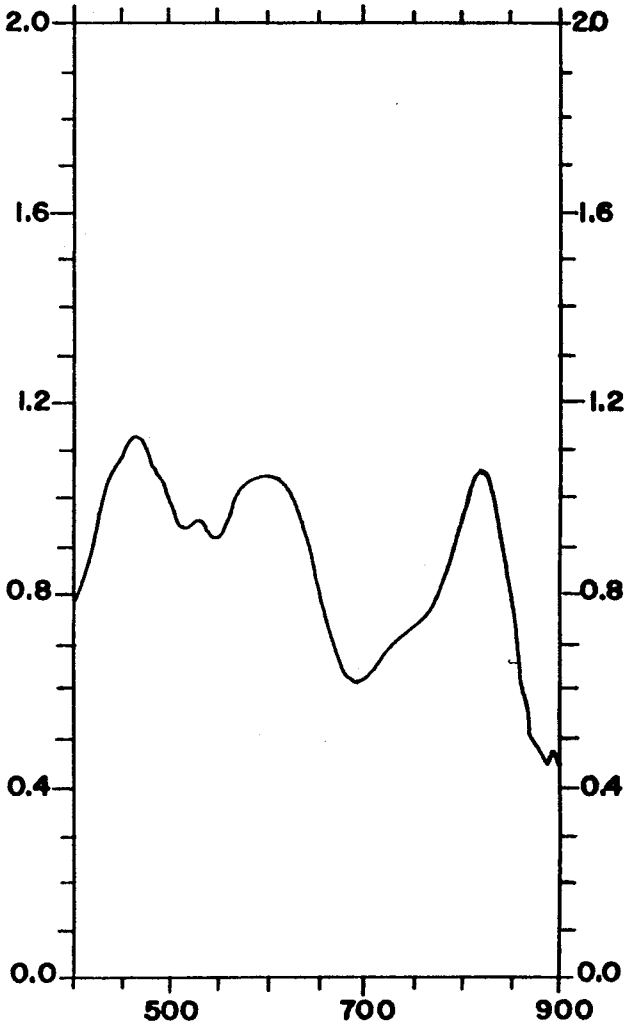
FIG. 7 is a plot similar to the plot of FIG. 3 showing the spectral absorption characteristics of the photoconductor element of Example 5.

The procedure of Example 1 was repeated except that the polycarbonate binder and the 1,1-bis(4-di p-tolylaminophenyl)cyclohexane were omitted from the cyanine layer. The spectral absorption characteristic of the photoconductor film element were found to be as shown in FIG. 7.

In each of Examples 1 through 5, the photoconductive response of the film element was measured by charging each element to minus 500 volts and then exposing the sample to a monochromatic light source as recorded in Table III below to decrease the initial voltage ($V_0$) to minus 100 volts.

TABLE III

| Photoconductive Response of Elements of Examples 1-5 Exposure Sensitivity (in ergs/cm$^2$) | | |
|---|---|---|
| Element of Example No.: | 630 nm | 810 nm |
| 1 | 4.8 | 99 |
| 2 | >1000 | >1000 |
| 3 | 3.9 | >1000 |
| 4 | 3.2 | >1000 |
| 5 | 6.8 | 105 |

In above Table III, the lower the exposure sensitivity value, the greater the film element sensitivity at the particular wavelength indicated. Since Example 2, which contained the cyanine dye but not the perylene dicarboximide pigment, exhibited significantly lower photo response than either Examples 1 or 5, which both contained the cyanine dye and the perylene dicarboximide pigment, and since the perylene dicarboximide pigment as such exhibited no measurable photo response at 810 nm, it is concluded that the perylene dicarboximide pigment acts as a sensitizer for the cyanine dye. Also, comparison of the photo response of Examples 1 and 5 indicates that similar photo response characteristics are obtained whether or not an added binder resin, such as for example, a polycarbonate, is present and whether or not a hole transfer agent, such as the 1,1-bis(4-di-p-tolylaminophenyl)cyclohexane, is present. Examples 1 through 5 illustrate the sensitization of the cyanine dye by the perylene dicarboximide pigment.

The following Examples 6 through 8 illustrate the sensitization of cyanine dye by perylene dicarboximide pigment deposited from a liquid dispersion.

EXAMPLE 6

A charge generation layer was prepared by adding 30.0 grams of Zirconia beads to a composition comprised as follows:

TABLE IV

| Comparative Charge Generation Layer Composition | |
|---|---|
| Component | Wt. in Grams |
| Polycarbonate[1] | 0.06 |
| Perylene Dicarboximide pigment of Formula (1) | 0.18 |
| Cyanine Dye of Formula (4) | 0.009 |
| Trichloroethylene | 11.8 |

Table IV footnote:
[1]The polycarbonate was obtained from the General Electric Company under the trade designation "ML4735".

This formulation was agitated on a "Red Devil" paint shaker for three hours after which the dispersion was coated on a vinylidene chloride subbed, nickelized polyethylene terephthalate film support prepared as described in Example 1 using a 0.002 inch coating blade. After drying, the coated film was cured for one hour at 60° C. The coating weight was about 0.1 g/ft$^2$ or a thickness of about 1 micron.

Thereafter, a charge transport layer composition prepared as described in Example 1 was applied in a manner identical to that employed in Example 1, air dried and then cured for one hour at 60° C.

EXAMPLE 7

The procedure of Example 6 was repeated except that to the charge generation layer dispersion there was added 0.036 grams of 1,1-bis(4-di-p-tolylaminophenyl) cyclohexane.

EXAMPLE 8

The charge generation layer dispersion was prepared similar to that used in Example 7 except that the cyanine dye of Formula 4 was omitted.

Each of the film elements of Examples 6, 7 and 8 was tested using the procedure used in evaluating the sensitivity of the respective elements of Examples 1 through 5 above. Thus, their photo response from minus 500 volts to minus 100 volts for the same monochromatic light source was measured. The data obtained is shown in the following Table V.

TABLE V

Photoconduction Response of Elements of Examples -9

| Element of Example No. | Exposure Sensitivity (ergs/cm$^2$) at specified nm | |
|---|---|---|
| | 630 nm | 810 nm |
| 6 | 17.5 | 443 |
| 7 | 12.5 | 423 |
| 8 | 13.4 | 3404 |

Comparison of the film element of Example 8, which does not contain a cyanine dye, with the film elements of respective Examples 6 and 7, each of which does contain the cyanine dye, indicates that the cyanine dye is sensitized by the dispersions of the perylene dicarboximide pigment.

The following examples illustrate how the photo response of a multi-active film element containing a vacuum deposited layer of the perylene dicarboximide pigment of formula (3) is affected when various cyanine dyes of differing redox potentials are substituted for the cyanine dye sensitizer of formula (4) above:

EXAMPLE 9

A film element was prepared using the procedure of Example 1 but employing only one-half of the quantity of the cyanine dye employed therein.

EXAMPLE 10

A multi-active film element was prepared using the procedure of Example 9 except that in place of the cyanine dye of Example 1, there was substituted the following cyanine dye:

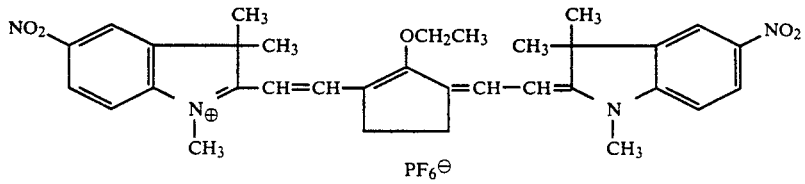

EXAMPLE 11

The multi-active film element was prepared using the procedure of Example 9 except that in place of the cyanine dye there was substituted a cyanine dye as shown in the following formula:

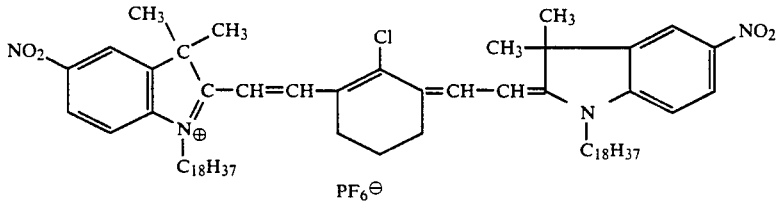

(6)

EXAMPLE 12

A multi-active film element was prepared using the procedure of Example 9 except that in place of the cyanine dye there was substituted cyanine dye of the following formula:

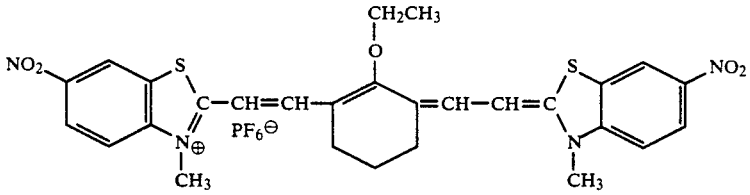

(7)

EXAMPLE 13

A multi-active film element was prepared using the procedure of Example 9 except that in place of the cyanine dye there was substituted a cyanine dye of the following formula:

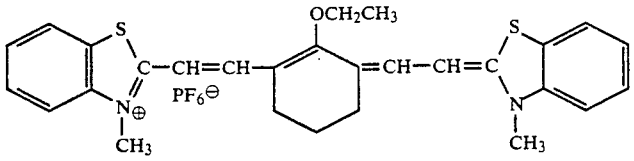

(7)

EXAMPLE 14

A multi-active film element was prepared using the procedure of Example 9 except that in place of the cyanine dye there was employed a cyanine dye of the following formula:

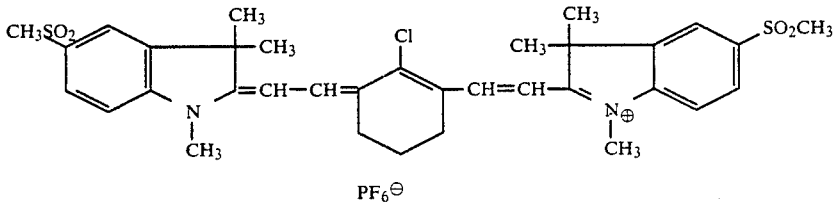

(9)

EXAMPLES 15-20

A set of multi-active film elements was produced using the procedure of Example 2 wherein the perylene dicarboximide pigment layer was omitted. In this set of experiments, each of Examples 9 through 14 was rerun without including the layer of perylene dicarboximide pigment.

The photoconductive response of each of the elements of Examples 9 through 20 was measured similarly to that above described in Examples 1 through 5. the results are shown in Table VI below along with the redox potential for each cyanine dye.

TABLE VI

Photoconductive Response of Elements of Examples 9-20 (Using Cyanine Dyes of Differing Redox Potential)

| Example | λmax | Exposure Sensitivity (ergs/cm$^2$) at: 630 nm | λmax,nm | Redox Potentials $E_{ox}$ | $E_{Red.}$ |
|---|---|---|---|---|---|
| 9 | 810 | 10 | 101.7 | — | — |
| 10 | 710 | | 56 | +1.02 | −0.53 |
| 11 | 810 | | 98.4 | +1.06 | −0.27 |
| 12 | 820 | | low $V_o$ = 325 | +0.83 | −0.42 |
| 13 | 770 | | low $V_o$ = 300 | +0.61 | −0.73 |
| 14 | 790 | | 54.6 | — | — |
| 15 | 810 | — | 1619 | | |
| 16 | 710 | — | 2581 | | |
| 17 | 810 | — | 999.4 | | |
| 18 | 820 | — | low $V_o$ = 175 | | |
| 19 | 770 | — | — | | |
| 20 | | — | 2540 | | |

As shown in Table VI, the photoconductive response was measured at 630 nm and at the appropriate absorption maxima shown in Table VI. The redox potential of the various dyes tested is also shown in Table VI for comparative purposes.

Table VI indicates that he cyanine dyes of Examples 10, 11 and 14 appear to be spectrally sensitized by the perylene dicarboximide pigment in the near infrared spectral region. Also, the Table VI data indicates that useful cyanine dye sensitizers have a favorable absorption maximum as well as an oxidation potential greater than about 1.0 volt along with a reduction poetential more negative than about minus 0.3 volt.

The data in Table VI indicates that the cyanine dyes used in this invention should preferably have a redox potential greater than about plus 1 volts in order to achieve the desired near infrared spectral sensitivity increase desired for photoconductor elements of the invention.

EXAMPLE 21

The procedure of Example 1 can be repeated except that in place of the perylene dicarboximide pigment employed in Example 1 there can be employed the following perylene pigment:

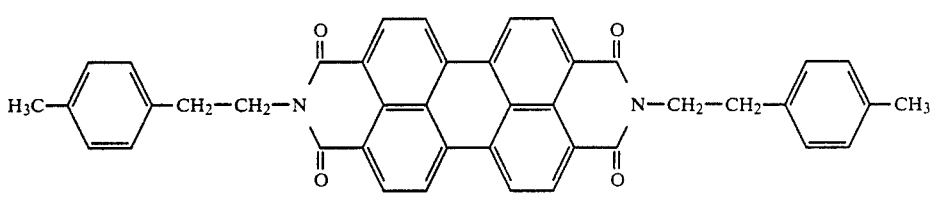

(10)

EXAMPLE 22

The procedure of Example 1 can be repeated except that in place of the perylene dicarboximide pigment employed in Example 1 there can be employed the following perylene pigment:

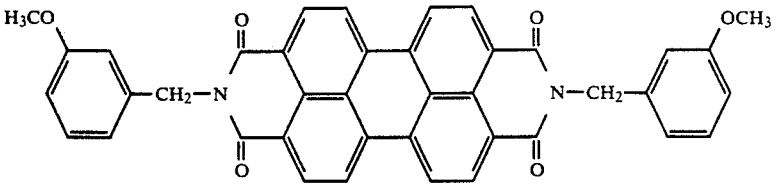

(11)

EXAMPLE 23

The procedure of Example 1 can be repeated except that in place of the perylene dicarboximide pigment employed in Example 1 there can be employed the following perylene pigment:

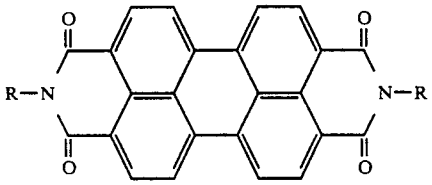

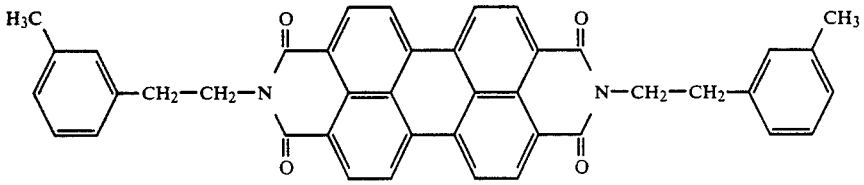

(12)

The foregoing specification is intended as illustrative and is not to be taken as limiting. Still other variations within the spirit and the scope of the invention are possible and will readily present themselves to those skilled in the art.

We claim:

1. A reusable photoconductor element having sensitivity in the near infrared spectral region comprising in combination successive adhering layers of:

(a) a substrate;
(b) an electrically conductive layer;
(c) a charge barrier layer;
(d) a first charge generation layer comprising at least one photosensitive, vaporizable, perylene dicarboximide pigment;
(e) a second charge generation layer comprising at least one photosensitive cyanine dye; and
(f) a charge transport layer.

2. The element of claim 1 wherein said perylene dicarboximide pigment is characterized by having the formula:

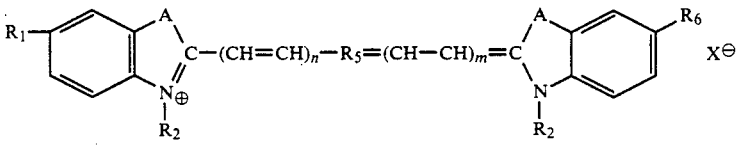

where R is an arylalkylene radical.

3. The element of claim 2 wherein said cyanine dye is characterized by having the formula:

wherein:

A is C $R_3R_4$ or S;
$R_1$ and $R_6$ are independently selected from hydrogen, nitro and $-SO_2CH_3$;
$R_2$, $R_3$ and $R_4$ are alkyl;
$R_5$ is

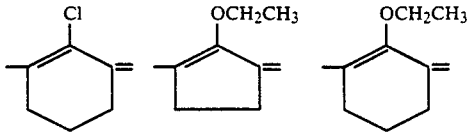

n is an integer of 1 through 3;
m is an integer of 1 through 3; and
X is an anion.

4. The element of claim 1 wherein said perylene dicarboximide pigment is characterized by the formula:

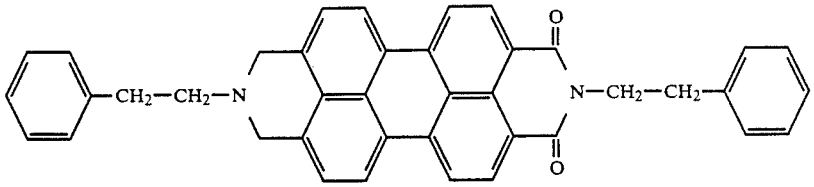
5. The element of claim 1 wherein said cyanine dye is characterized by the formula:
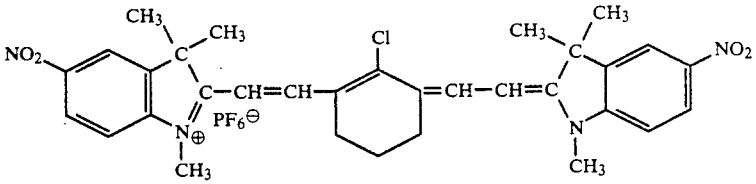
6. The element of claim 1 where, in said second charge generator layer, said cyanine dye is dispersed in a polymeric binder.
* * * * *

UNITED STATES PATENT AND TRADEMARK OFFICE

CERTIFICATE OF CORRECTION

PATENT NO. : 5,028,504

DATED : July 2, 1991

INVENTOR(S) : Norman G. Rule and William J. Staudenmayer

It is certified that error appears in the above-identified patent and that said Letters Patent is hereby corrected as shown below:

In column 7, line 60, "metalloorganic" should be --metallo organic--;

In column 11, line 41, "absorpotion" should be --absorption--;

In column 16, line 15, "he" should be --the--;
line 32, "poetential" should be --potential--.

UNITED STATES PATENT AND TRADEMARK OFFICE

CERTIFICATE OF CORRECTION

PATENT NO. : 5,028,504

DATED : July 2, 1991

INVENTOR(S) : Norman G. Rule and William J. Staudenmayer

It is certified that error appears in the above-identified patent and that said Letters Patent is hereby corrected as shown below:

In column 19, the formula:

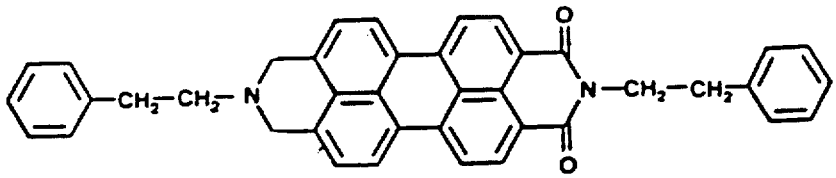

should be:

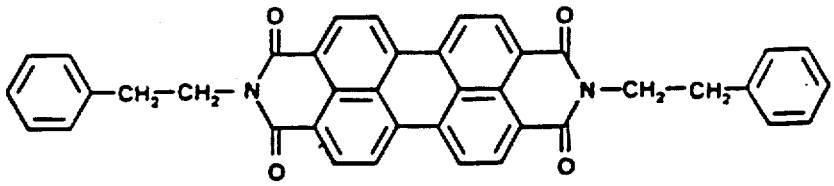

Signed and Sealed this

Second Day of February, 1993

*Attest:*

STEPHEN G. KUNIN

*Attesting Officer*

*Acting Commissioner of Patents and Trademarks*